US008198967B2

(12) United States Patent
Eriksson et al.

(10) Patent No.: US 8,198,967 B2
(45) Date of Patent: Jun. 12, 2012

(54) INDUCTION DEVICE

(75) Inventors: Anders Bo Eriksson, Ludvika (SE); Julia Forslin, Ludvika (SE); Jan Anger, Ludvika (SE); Jan Hajek, Ludvika (SE)

(73) Assignee: ABB Technology AG (CH)

( * ) Notice: Subject to any disclaimer, the term of this patent is extended or adjusted under 35 U.S.C. 154(b) by 0 days.

(21) Appl. No.: 13/153,006

(22) Filed: Jun. 3, 2011

(65) Prior Publication Data

US 2011/0227687 A1 Sep. 22, 2011

Related U.S. Application Data

(63) Continuation of application No. PCT/EP2008/066764, filed on Dec. 4, 2008.

(51) Int. Cl.
*H01F 17/06* (2006.01)

(52) U.S. Cl. ..... 336/178

(58) Field of Classification Search ..... 336/65, 336/83, 178, 212, 234
See application file for complete search history.

(56) References Cited

U.S. PATENT DOCUMENTS 5,726,617 A 3/1998 Pla et al.
5,999,077 A * 12/1999 Hammond et al. ..... 336/134

FOREIGN PATENT DOCUMENTS

EP 0083718 A1 7/1983
JP 02201908 A * 8/1990
JP 6302441 A 10/1994
JP 2006308521 A * 11/2006
WO 0175911 A1 10/2001

OTHER PUBLICATIONS

International Search Report and Written Opinion of the International Searching Authority; PCT/EP2008/066764; Aug. 26, 2009; 15 pages.
Ishikawa, et al.; "Reactor Vibration Analysis in Consideration of Coupling Between the Magnetic Field and Vibration"; Industry Applications Conference; 2004; pp. 872-877.

* cited by examiner

*Primary Examiner* — Tuyen Nguyen
(74) *Attorney, Agent, or Firm* — St. Onge Steward Johnston & Reens LLC

(57) ABSTRACT

An induction device to be used in association with a high voltage electric transmission systems having at least one winding, at least one core frame, and at least one magnetic core leg arranged in the core frame. The core frame includes a plurality of core gaps including a plurality of spacers, and a plurality of core segments of a magnetic material. The core segments are being separated by at least one of the core gaps, and the winding is causing electromagnetic attraction forces to act in the core gaps. The induction device further includes at least one piezoelectric element arranged in one of the core gaps, and a control unit connected to the piezoelectric element. The control unit is arranged to provide an electrical signal for inducing vibrations of the piezoelectric element which counteract the electromagnetic attraction forces acting in the core gaps.

9 Claims, 2 Drawing Sheets

INDUCTION DEVICE

CROSS-REFERENCE TO RELATED APPLICATIONS

The present application is a continuation of International patent application PCT/EP2008/066764 filed on Dec. 4, 2008 which designates the United States, the content of which is incorporated herein by reference.

FIELD OF THE INVENTION

The present invention relates to an induction device to be used in association with high-voltage electric transmission systems above 1 kV. The invention is particularly applicable to a shunt reactor, called to provide power of the order of several tens of MVA, for use in a power system, for example in order to compensate the capacitive reactance of long electricity power transport lines, which are generally high-voltage power lines or extended cable systems.

BACKGROUND OF THE INVENTION

The function of a shunt reactor is generally to provide a required inductive compensation necessary for power line voltage control and stability in high-voltage transmission lines or cable systems. The prime requisites of a shunt reactor are to sustain and manage high voltage and to provide a constant inductance over a range of operating inductions. At the same time, shunt reactors are to have low profile in size and weight, low losses, low vibration and noise, and sound structural strength.

A shunt reactor generally comprises a magnetic core composed of one or more core legs, also denoted core limbs, connected by yokes which together form one or more core frames. Further, a shunt reactor is made in such manner that a coil encircles said core leg. It is also well known that shunt reactors are constructed in a manner similar to the core type power transformers in that both use high permeability, low loss grain oriented electrical steel in the yoke sections of the cores. However, they differ markedly in that shunt reactors are designed to provide constant inductance over a range of operating inductions. In conventional high-voltage shunt reactors, this is accomplished by use of a number of large air gaps in the core leg section of the core. Said core legs are being fabricated from core segments, also denoted packets, of magnetic material such as electrical steel strips. Said core segments are made of high quality radial laminated steel sheets, layered and bonded to form massive core elements. Further, said core segments are stacked and epoxy-bonded to form a core leg with high modulus of elasticity. The core legs are constructed by alternating the core segments with ceramic spacers to provide a required air gap. Said core segments are separated from each other by at least one of said core gaps and said spacers are being bonded onto said core segments with epoxy to form cylindrical core elements. Further, said spacers are typically made of a ceramic material such as steatite, which is a material with high mechanical strength, good electrical properties and a small loss factor.

Said core is accommodated in a tank comprising a tank base plate and tank walls together with a foundation supporting the tank. It is also well known that induction devices, such as shunt reactors, are immersed in cooling medium such as oil, silicone, nitrogen or fluoro-carbons.

It is a well-known problem that the magnetic core is a source of noise in electric induction devices such as transformers and reactors, and that such noise, also denoted hum, emitted from the reactor must be limited in order not to disturb the surrounding areas. Current is flowing through electrical windings surrounding the core, thus generating a magnetic field. Therefore, alternating magnetization of the core will take place, whereby the core segments cyclically expand and contract, due to the fact that ferromagnetic materials change their shape when subjected to a magnetic field, also known as the phenomena of magnetostriction, when magnetized and demagnetized by the current flowing in the reactor windings. The magnetic core thus acts as a source of 100 Hz or twice the operating frequency of the reactor vibrations and harmonics thereof. As the magnetic field through the core alternates, the core segments will expand and contract over and over again, causing vibrations. The act of magnetization by applying a voltage to the reactor produces a flux, or magnetic lines in the core. The degree of flux will determine the amount of magnetostriction, and hence the noise level. Said vibrations produce the sound waves that create the reactor's distinctive hum.

Also the previously mentioned core gaps filled with spacers, through which magnetic flux will pass by, are sources of vibrations causing noise. This is due to the fact that when said magnetic flux alternates it tends to compress/decompress the ceramic spacers, thereby causing vibrations in the core. Dynamic electromagnetic core gap forces will cause vibrations of the core which is the major source of noise. Today there are basically two ways to reduce the magnitude of the vibrations caused by the core gap forces, e.g. by reducing core gap forces or by increasing the core gap stiffness. Since the magnitude of the core gap forces is strongly dependent on the rated power of the induction device, the most efficient way to reduce the noise is to increase the stiffness of the core gaps.

In the US, the mains voltage alternates 60 times every second (60 Hz), so that the core segments expand and contract 120 times per second, producing tones at 120 Hz and its harmonics. In Europe, where the mains supply is 50 Hz, the hum is nearer 100 Hz and its harmonics.

The vibrations generated by the magnetic core together with the weight of the core and core assembly may force the rigid base structure beneath a reactor casing into vibration. The casing sidewalls might be rigidly connected to the base structure and may thereby be driven into vibration by the stiff base members and propagate noise.

In oil immersed induction devices to which the present invention relates, the magnetic core is placed in a tank, and the vibrations are propagating by the tank base and the oil to the tank walls causing noise.

SUMMARY OF THE INVENTION

The present invention seeks to provide an improved induction device which reduces the vibrations in the reactor core leg, thus reducing the noise level emitted from the reactor.

The object of the invention is achieved by an induction device as defined in claim 1. The device is characterised in that the induction device comprises at least one piezoelectric element arranged in one of the core gaps, and a control unit connected to the piezoelectric element, and arranged to provide an electric signal for inducing vibrations of the piezoelectric element in counter phase with the electromagnetic attraction forces acting in the core gap. The idea is to counteract and stop vibrations in the magnetic core leg caused by electromagnetic forces with the help of an electric field affecting the piezoelectric element. The size of the piezoelectric element will change, due to converse piezoelectric effect, when affected by an electric field and thereby the filling of the core gap will increase. Accordingly, due to the fact that the piezoelectric effect is reversible, the core leg will be decompressed when the applied electric field is diminished, and thus the size of the piezoelectric element will decrease. The core leg will be expanded in a longitudinal direction when an electric field (100-120 V) is fed to the piezoelectric element, causing said elements to expand in a longitudinal direction, and thus the vibrations in the core leg will be diminished. The expansion of the piezoelectric element shall counteract the compression that takes place in the core leg in order to preserve the length of the core leg. Thus fewer vibrations will be transferred from the core leg to the core frame and less noise will be emitted from the induction device.

According to one embodiment of the invention the plurality of core gaps includes a plurality of spacers and the piezoelectric elements are arranged between the spacers and the core segments or between the spacers and the core frame. Thereby it is possible to conform the core leg for minimum occurrence of vibrations being transferred from the core leg to the core frame.

According to a further embodiment of the invention the plurality of core gaps includes a plurality of spacers and the piezoelectric element are arranged between the spacers and the core segments and between the spacers and the core frame. Thereby piezoelectric elements will act in the core leg reducing vibrations and in the attachment points between the core leg and the core frame, thus reducing vibrations and preventing the vibrations from being transferred into the core leg.

According to an embodiment of the invention, at least one sensor is arranged to measure vibrations in the core leg. The sensor is configured to send measured values to the control unit, and the control unit is configured to generate the electrical signal based thereon.

Thereby a smooth and efficient cancellation of vibrations generated in the core leg will be achieved and it will be possible to reduce the noise emitted from the induction device.

According to a further embodiment of the invention, the sensor is arranged to measure sounds emitted from the induction device. Thereby it will be possible to arrange the sensor outside the induction device.

According to one further embodiment, the induction device is a shunt reactor.

Further features and advantages of the present invention will be presented in the following detailed description of a preferred embodiment of the induction device according to the invention.

BRIEF DESCRIPTION OF THE DRAWINGS

Other features and advantages of the present invention will become more apparent to a person skilled in the art from the following detailed description in conjunction with the appended drawing in which.

DETAILED DESCRIPTION OF THE INVENTION

Figure 1:
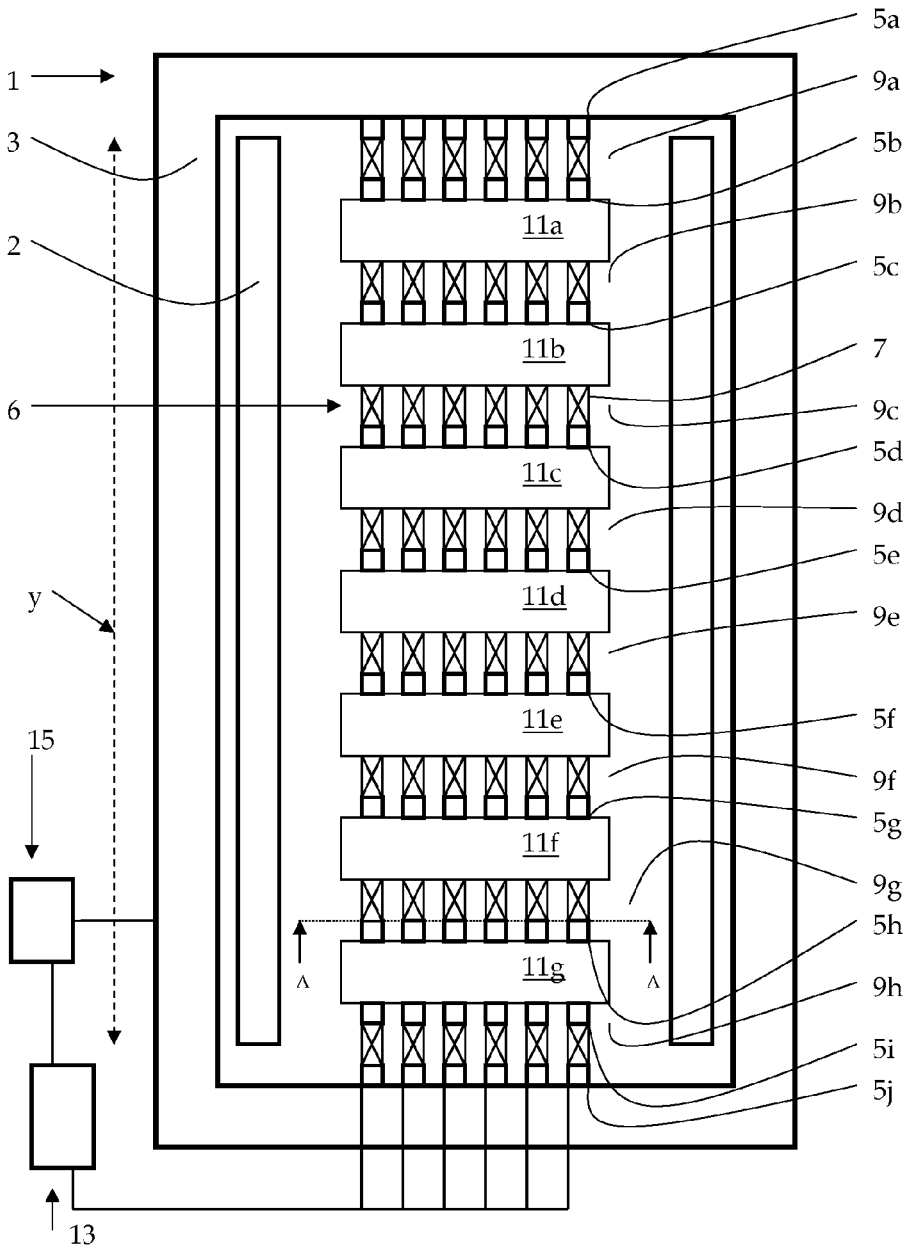
FIG. 1. is a longitudinal cross-sectional view through an induction device according to an embodiment of the invention.

FIG. 1 shows an induction device 1 according to an embodiment of the invention. The induction device 1 is arranged to be used in association with high voltage electric transmission systems. The induction device 1 is used for the purpose of compensating the capacitive reactance of long electricity power transport lines, which are generally high-voltage power lines or extended cable systems. The induction device 1 can be placed permanently in service to stabilize power transmission, or switched in under light-load conditions for voltage control only.

The induction device 1 comprises a core frame 3, a winding 2, and a magnetic core leg 6 arranged in the core frame 3. The core leg 6 comprises a plurality of core segments 11*a*-11*g* being composed of a magnetic material. The core segments 11*a*-11*g* are typically made of high-quality radial laminated steel sheets layered and bonded to form massive core elements, and have a cross-section of circular shape with an upper and a lower end-face as seen in a longitudinal direction along the core leg 6. Further the core segments 11*a*-11*g* are stacked and epoxy-bonded to form a leg with high modulus of elasticity. The core segments 11*a*-11*g* are each arranged at a predetermined distance from each other in a longitudinal direction along the core leg 6. The predetermined distance as described above constitutes a plurality of core gaps 9*a*-9*h*. In each core gap 9*a*-9*h* there is arranged a plurality of spacers 7 (all spacers are denoted as number 7 for the sake of simplicity), with an upper and a lower end-face, for the purpose of retaining the predetermined distance between the core segments 11*a*-11*g*. The shape of the spacer cross-section appearance of the upper and lower end-face, seen in a longitudinal direction along the core leg 6, is, for example polygonal, circular or oval.

In one or more of the core gaps 9*a*-9*h* there are arranged piezoelectric elements 5*a*-5*j*, each with an upper and a lower end-face seen in a longitudinal direction along the core leg 6, between the end-faces of the spacers 7 and the end-faces of the core segment 11*a*-11*g*. The shape of the upper and lower end face of the piezoelectric element corresponds to the shape of end faces of the spacers as described above. The core leg 6 is arranged to establish a certain magnetic resistance (reluctance), which in turn sets the inductance of the device 1. The major part of the magnetic flux passes through the core leg 6 with alternating magnetic properties, which causes attraction forces to act in the core gaps 9*a*-9*h*. Thus the attraction forces will compress the core leg 6. The spacers 7 are typically made of a ceramic material such as steatite. The piezoelectric elements 5*a*-5*j* are made of materials such as lead zirconate titanate (PZT), barium titanate or lead titanate. Also materials like quartz and tourmaline, which are naturally occurring crystalline materials possessing piezoelectric properties, can be used as well as artificially produced piezoelectric crystals like Rochelle salt, ammonium dihydrogen phosphate and lithium sulphate. The piezoelectric elements are being arranged to expand or shrink in a preferably longitudinal direction (y) along the core leg 6.

A sensor 15 is arranged for sensing and measuring vibrations in the core leg and is being connected to a control unit 13. The sensor 15 can be arranged anywhere inside the induction device 1, or outside adjacent to the induction device 1, for the purpose of measuring the vibrations generated in the core leg 6 or for measuring the vibrations generated from the core leg 6 to the structure such as the tank walls or the base structure, of the induction device 1. Another alternative is to arrange the sensor 15 anywhere inside the induction device 1, or outside adjacent to the induction device 1, for the purpose of measuring noise emitted from the induction device 1. Another alternative is to arrange more than one sensor 15 for vibration or sound measurements. An improved accuracy regarding the measurement of vibration or sounds can be achieved by arranging more than one sensor 15 inside the induction device 1 or outside the induction device 1. Alternatively, sensors 15 can be arranged both inside the induction device 1 and outside the induction device 1. The sensor 15 is connected to the control unit 13 which in turn is connected to the piezoelectric elements 5*a*-5*j*. The control unit 13 comprises a memory unit, a processing device, hardware and software. The software is configured, based on the vibrations in the core leg 6 measured by the sensor 15, to calculate the strength of and provide a variable electric signal for the purpose of inducing vibrations in the piezoelectric elements 5*a*-5*j*. The variable electric signal shall counteract the electromagnetic attraction forces acting in the core gap 9*a*-9*h*. A center hole (not shown) is arranged vertically through the core frame 3 and the core leg 6 for the purpose of being able to lift and transport the induction device 1. The sensor 15 is any device arranged for measuring, vibrations or sounds such as an accelerometer, a microphone, an omni directional movement sensor, a vibration sensor, a tilt sensor or a shock sensor.

The arrangement of the piezoelectric elements 5*a*-5*j* in the core leg 6 may be achieved in many different configurations in the core gaps 9*a*-9*h*.

As can be seen in FIG. 1, one or more piezoelectric elements 5*a* is arranged in core gap 9*a* between the upper end faces of the spacers 7 and the core frame 3. Also one or more piezoelectric elements 5*b* can be arranged between the lower end faces of the spacers 7 and the upper end face of the core segment 11*a*.

In core gap 9*h*, one or more piezoelectric elements 5*j* can be arranged between the lower end faces of the spacers 7 and the core frame 3. Also one or more piezoelectric elements 5*i* can be arranged between the upper end faces of the spacers 7 and the lower end face of the core segment 11*g*.

In core gaps 9*b*,9*c*,9*d*,9*e*,9*f*, one or more piezoelectric elements 5*c*,5*d*,5*e*,5*f*,5*g*,5*h* can be arranged between the lower end faces of the spacers 7 and the upper end faces of the core segments 11*b*,11*c*,11*d*,11*e*,11*f*.

One additional possibility, regarding the core gaps 9*b*,9*c*, 9*d*,9*e*,9*f*, is to arrange one or more piezoelectric elements 5*c*,5*d*,5*e*,5*f*,5*g*,5*h* between the upper end faces of the spacers 7 and the lower end faces of the core segments 11*b*,11*c*,11*d*, 11*e*,11*f*.

One possible arrangement is to arrange piezoelectric elements 5*c*,5*d*,5*e*,5*f*,5*g*,5*h* in a limited number of the core gaps 9*b*,9*c*,9*d*,9*e*,9*f*.

One additional possibility, regarding the core gaps 9*b*, 9*c*, 9*d*, 9*e*,9*f*, is not to arrange any piezoelectric elements between end faces of the spacers and the end faces of the core segments 11*b*,11*c*,11*d*,11*e*,11*f*.

Consequently, one or more piezoelectric elements 5*a*,5*b*, 5*i*,5*j* will be arranged in the core gaps 9*a*,9*h* only.

Another possibility is to arrange one or more piezoelectric elements in the core gaps 9*b*-9*g* between the upper side of the end faces of the spacers 7 and the lower side of the end faces of the core segments 11*a*-11*f* and between the lower side of the end faces of the spacers 7 and the upper side of the end faces of the core segments 11*b*-11*g*. Thereby each core gap 9*b*-9*g* will consist of piezoelectric elements arranged both on the spacer 7 upper end faces and the spacer 7 lower end faces.

The length (in a longitudinal direction) of the spacers 7 may differ depending on whether piezoelectric elements 5*a*-5*i* are attached to their end faces or not.

Figure 2:
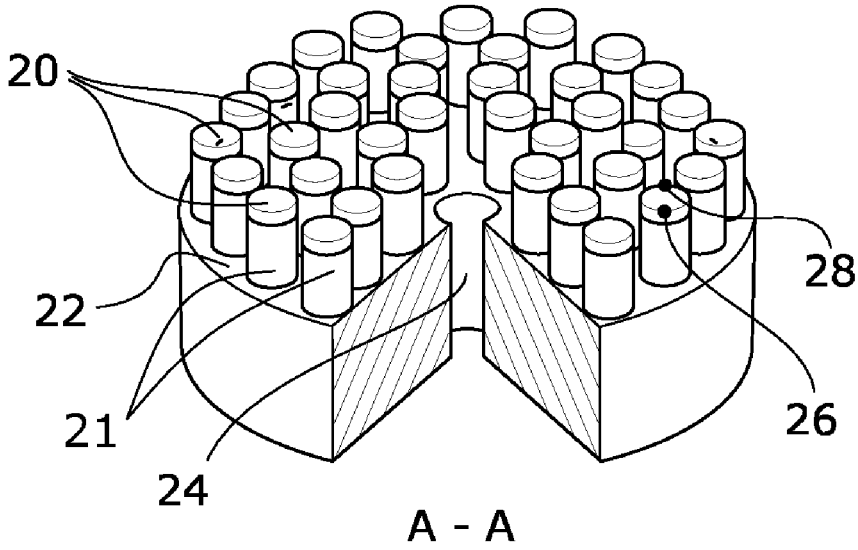
FIG. 2. is a cross-sectional view, A-A, through the core leg of the induction device shown in FIG. 1.

FIG. 2 illustrates a core gap, in a cross section A-A through the device shown in FIG. 1. Spacers 21 are arranged on the upper end face of a core segment 22, and piezoelectric elements 20 are arranged to the upper end face of the spacers 21. A center hole 24 is arranged in a longitudinal direction through the core segment 22. The magnetic field (not shown) acts in a longitudinal direction through the piezoelectric elements. Each piezoelectric element 20 is connected to the control unit (not shown) with connecting means 26,28. However only one of the piezoelectric elements is illustrated with connecting means for the sake of simplicity.

Figure 3:
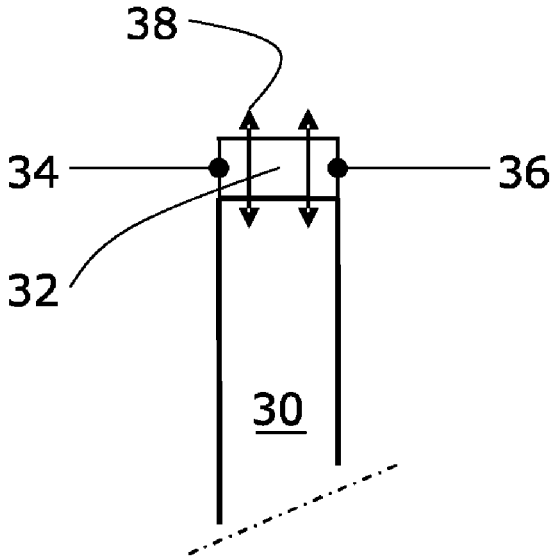
FIG. 3. is a longitudinal cross-sectional view through a spacer with a piezoelectric element attached to its upper end face according to the invention.

FIG. 3 illustrates a spacer 30 with a piezoelectric element 32 attached to its upper end face. The piezoelectric element 32 is connected to the control unit (not shown) by means of illustrated connecting means 34,36. Also the magnetic field 38 which acts in a longitudinal direction through the piezoelectric element 32 is shown. The connecting means 34,36 can be arranged to connect to the piezoelectric element 32 either by using the center hole or by using the space between the core frame and the core leg.

What is claimed is:

1. An induction device to be used in association with high-voltage electric transmission systems, comprising:

at least one winding;

at least one core frame; and at least one magnetic core leg arranged in said core frame, and comprising a plurality of core gaps, and a plurality of core segments of a magnetic material separated by said core gaps, and wherein said winding is causing electromagnetic forces to act in said core gaps;

wherein the induction device further comprises at least one piezoelectric element arranged in one of said core gaps, and a control unit connected to the piezoelectric element that provides an electric signal that induces vibrations of said piezoelectric element which counteract said electromagnetic attraction forces acting in said core gaps.

2. The induction device according to claim 1, wherein said plurality of core gaps includes a plurality of spacers and that said piezoelectric element is arranged between said spacers and said core segments or between said spacers and said core frame.

3. The induction device according to claim 1, wherein said plurality of core gaps includes a plurality of spacers and that said piezoelectric element is arranged between said spacers and said core segments and between said spacers and said core frame.

4. The device according to claim 3, comprising at least one sensor is arranged to measure vibrations in said core leg and to send measured values to the control unit, and said control unit is configured to generate said electrical signal based thereon.

5. The device according to claim 4, wherein said sensor is an accelerometer.

6. The device according to claim 4, wherein said sensor is adapted to measure sounds.

7. The device according to claim 1, wherein said induction device is a shunt reactor.

8. The device according to claim 1, comprising at least one sensor is arranged to measure vibrations in said core leg and to send measured values to the control unit, and said control unit is configured to generate said electrical signal based thereon.

9. The device according to claim 2, comprising at least one sensor is arranged to measure vibrations in said core leg and to send measured values to the control unit, and said control unit is configured to generate said electrical signal based thereon.

* * * * *